United States Patent [19]

Michaud

[11] 4,392,289

[45] Jul. 12, 1983

[54] MANUFACTURE OF JEWELRY BY CASTING WITH PRESET GEMS

[75] Inventor: Franck Michaud, Lyons, France

[73] Assignee: Charles Hoffert of America, Inc., Miami, Fla.

[21] Appl. No.: 268,780

[22] Filed: Jun. 1, 1981

[51] Int. Cl.[3] ..... B22C 7/02; B22C 9/04; B22D 19/00

[52] U.S. Cl. ..... 29/160.6; 29/527.6; 63/28; 164/9; 164/10; 164/35

[58] Field of Search ..... 164/34, 9, 10, 11, 35; 63/26, 27, 28; 264/DIG. 55; 29/10, 160.6, 527.6

[56] References Cited

U.S. PATENT DOCUMENTS

| | | | |
|---|---|---|---|
| 1,997,500 | 4/1935 | Swarovski | 63/28 X |
| 2,163,814 | 6/1939 | Swarovski | 29/160.6 X |
| 2,749,597 | 6/1956 | Fus | 29/160.6 X |
| 2,790,220 | 4/1957 | Fox | 164/35 |
| 2,887,746 | 5/1959 | Bogoff | 164/9 |
| 4,154,282 | 5/1979 | Kull | 164/34 X |

*Primary Examiner*—Gus T. Hampilos
*Assistant Examiner*—J. Reed Batten, Jr.
*Attorney, Agent, or Firm*—Erwin M. Barnett

[57] ABSTRACT

Articles of jewelry with gems set in precious metal are cast by a modified lost wax method whereby each gem is retained in position in the investment mold after removal of the wax enabling the setting of the gem to be simultaneous with the casting of the precious metal. The wax model of the article of jewelry is molded with undercut grooves in the sidewall of the gem seat located to engage portions of the girdle of the gem for retention thereof in set position in the finished article. The wax for the model is formulated to provide resiliency to permit the gem to be snapped into position in the wax model prior to embedding the model with the gem set therein in investment material in the conventional flask. Curing time is reduced to approximately one half the conventional fourteen hours by precise control of predetermined time and temperature which also prevents marring of the gems during the curing of the investment and the casting of the precious metal.

9 Claims, 7 Drawing Figures

MANUFACTURE OF JEWELRY BY CASTING WITH PRESET GEMS

BACKGROUND OF THE INVENTION

1. Field of the Invention

This invention relates to articles of jewelry made of precious metal set with one or more gems and more particularly is directed to an improved utilization of the lost wax method of casting such articles of jewelry whereby the gem is set in the wax model and encased in the investment material enabling the article of jewelry to be cast in precious metal with the gem properly mounted in the setting when the casting is removed from the investment mold.

2. Description of the Prior Art

The desirability to reduce the dependence by manufacturers of articles of jewelry having gems set in precious metal on the high priced labor of skilled gem setters has long been recognized. In this regard, U.S. Pat. No. 4,154,282 granted to Herbert Kull on May 15, 1979 utilizes the lost wax process for manufacturing such jewelry by forming the rubber mold in which the wax model is cast to accommodate the gem and positioning the latter in the rubber mold prior to closing the mold and injecting the wax. The wax model bearing the gem set therein is removed from the rubber mold and encased in the investment so that, after replacement of the wax by precious metal in accordance with the lost wax procedure, the cast article is removed from the investment mold with the gem preset in the metal and thereby eliminating the conventional step of setting the gem in the cast metal.

The conventional method of melting and removing the wax model and curing the investment mold preparatory to casting the precious metal therein is performed in an oven under reduced pressure and involves increasing the temperature by uniform increments to 700° C. in 14 hours to completely remove the moisture and provide a hard, smooth interior mold surface against which the metal is cast. The Kull patent suggests that this preheating or curing of the investment mold be accomplished in 4 hours at temperatures not to exceed 500° C.

In attempting to achieve the desired result of eliminating the need for a skilled gem setter to complete the article of jewelry, the method described in the Kull patent has been found to be inadequate in two respects, namely, (1) in the manner whereby the gem is set in the wax model and (2) the suggested procedure for curing the investment mold preparatory to casting the precious metal therein.

As to the first inadequacy, the step of properly positioning the gem as an insert in the open rubber mold and then closing the mold with a high degree of care so as not to displace the gem prior to injecting the wax has been found not only to be relatively time consuming but also unreliable, particularly when the jewelry design utilizes several relatively small gems in each article. Furthermore, any improper positioning of the gem during the molding of the wax model is not apparent until after the model is removed from the mold. Other imperfections in the wax model per se requires removal of the gems before discarding such defective model. All these all too frequent eventualities contribute to what is believed to be an unacceptable efficiency rate at this stage of the process.

As to the above mentioned second inadequacy, by limiting the curing of the investment material to a period of 4 hours at temperatures not to exceed 500° C. required by Kull in order to prevent damage to the gems now retained in the investment mold after removal of the wax, the reduction in moisture content and hardening of the investment material has been found to be insufficient to enable the investment mold to withstand the injection of the molten metal which damages salient areas of the mold resulting in defective and unacceptable castings.

It is thus clear that the need to provide a practical, dependable, commercially feasible and efficient method of manufacturing cast precious metal jewelry with preset gems still exists.

SUMMARY OF THE INVENTION

Among the objects of the invention is to improve the lost wax method for casting articles of jewelry made of precious metal set with gems which will satisfy the need hereinbefore mentioned for reducing the cost of manufacture by eliminating the costly services of highly skilled gem setters as well as the problems and disadvantages of those prior art methods intended to achieve the same results. The improved method shall comprise steps which are readily performed by those versed in lost wax procedures, shall utilize existing equipment and shall be economical, practical and efficient to a high degree.

The improved method comprises a first, namely, wax molding and gem setting, phase wherein a wax model of the article of jewelry, which when completed will be set with one or more gems, is molded in a rubber mold made from a master in which the sidewall of the seat for the setting of each gem is formed with opposing undercut grooves located to engage portions of the girdle of the gem as the means for securing such gem in the setting. The model is molded of a predetermined mixture of green and yellow jewelry casting waxes for the proper elastic consistency to enable the gem to be preset in the wax model by exerting a slight downward pressure on the crown of the gem thereby snapping the girdle into seated position in the undercut grooves.

The second, namely, wax removal, investment curing and final metal casting, phase of this method includes the general steps of mounting on a wax tree one or more wax models of the jewelry in which the gems have been set, placing the tree in a flask, pouring the investment material into the flask surrounding and covering the tree, curing the investment material, during which step the wax is eliminated while the gems are retained in proper position by the investment material, then casting the precious metal in the cured investment mold, the metal replacing the wax with the gems preset therein, and finally polishing the metal to a desired finish.

The curing step uses conventional vacuum oven heating equipment but, in order to prevent damage to the gems, the invention carefully controls the temperature to a maximum of about 600° C. as compared to 700° C. in conventional curing and reduces the curing time from the conventional 14 hours to 7 hours. The investment mold is then cooled to between 547° C. and 550° C. at which temperature the molten precious metal is injected in a conventional centrifugal casting operation. Thereafter, the investment mold with the metal cast therein is permitted to slowly cool by ambient air to a temperature at which the mold may be broken and the jewelry article with the gem preset therein removed for polishing.

DESCRIPTION OF THE PREFERRED EMBODIMENTS

The method embodying the invention is herein illustrated by a step by step description of the manufacture of a representative article of jewelry set with several gems and more specifically a precious metal finger ring having three gems preset therein. Preparatory to the wax molding and gem setting phase of the method, a master metal model of the article of jewelry is made having all the desired design features of the metal component of the finished piece and also the structural elements required for presetting the gems in accordance with the invention. A rubber mold in which wax models of the finger ring are to be cast is then made from the master model in accordance with well known lost wax procedure.

Figure 1:
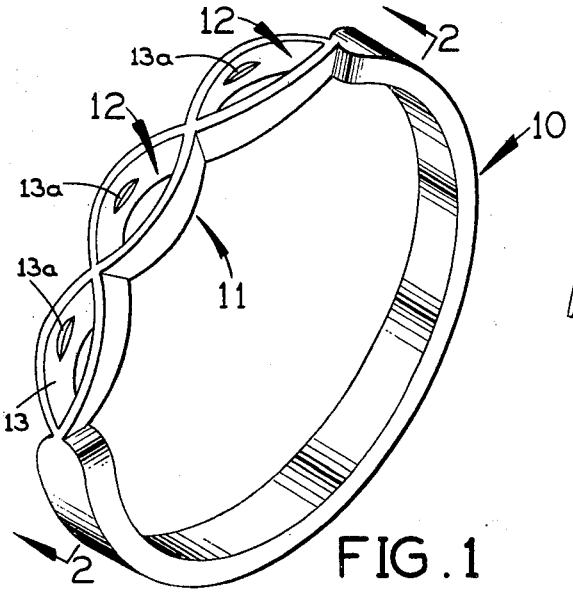
FIG. 1 is a perspective view of a metal master ring having setting seats for three gems constructed with undercuts embodying the invention.
Figure 2:
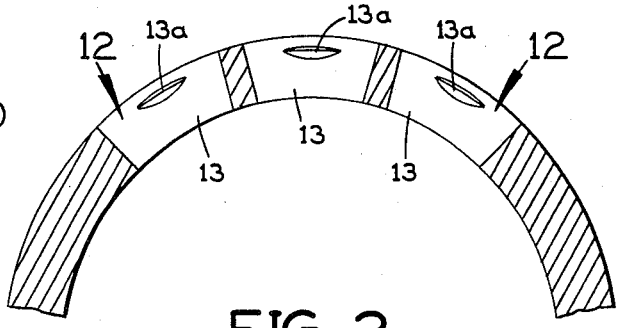
FIG. 2 is a fragmentary sectional view taken on line 2—2 in FIG. 1.

Referring in detail to the drawing, 10 denotes such finger ring master model shown in FIGS. 1 and 2 to comprise a decorative, gem bearing section 11 having three seats 12 constructed to accommodate gems 15 which will subsequently be preset in the final precious metal casting in accordance with the invention. The sidewall 13 of each seat 12 is formed on opposite portions thereof with a pair of undercut grooves 13*a* facing each other to serve as the setting or retaining means for gem 15 by being sized and located to engage girdle 15*a* of gem 15 when set in seat 12 as hereinafter described.

Figure 3:
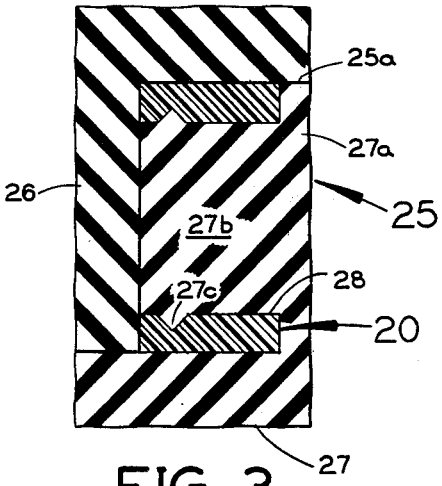
FIG.3 is an enlarged fragmentary sectional view of a rubber mold made from the master shown in FIGS. 1 and 2 taken perpendicular to the mold parting line and through one of the setting seats and shown with the wax cast therein.
Figure 4:
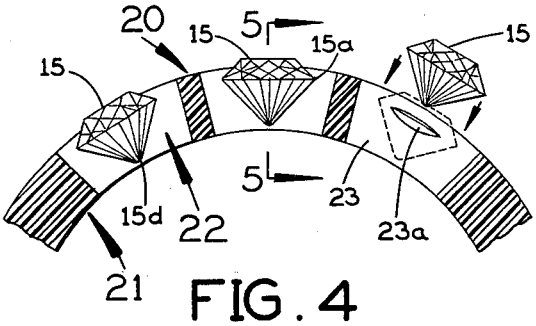
FIG. 4 is a fragmentary sectional view similar to FIG. 2 but of the wax model of the ring after removal from the mold shown in FIG. 3, two gems being shown set, the third gem being shown aligned above its seat preparatory to being snapped into seated position.

Rubber mold 25, having been made from master model 10 and shown in FIG. 3 in closed position with cavity 28 filled with wax, serves for individually molding one or more wax models 20, each finished ring of precious metal being produced from its own wax model 20. As seen in FIG. 4, wax model 20 duplicates ring 10 and has corresponding decorative section 21 formed with three seats 22 each having a sidewall 23 formed with undercut grooves 23*a*. As seen in FIG. 3, rubber mold 25 comprises upper mold section 26 and lower mold section 27 which are separable along parting line 25*a*. The latter is cut to provide a generally circular portion 27*a* which extends upwardly from lower section 27 to define the center opening in the ring and cooperates with a recessed depression in upper mold section 26 to form mold cavity 28. Portion 27*a* has a lateral projection 27*b* defining each of the seats 22, projections 27*b* in turn each having a pair of opposite ledges 27*c* forming undercut grooves 23*a* in the sidewall 23 of each seat 22 of wax model 20.

Figure 5:
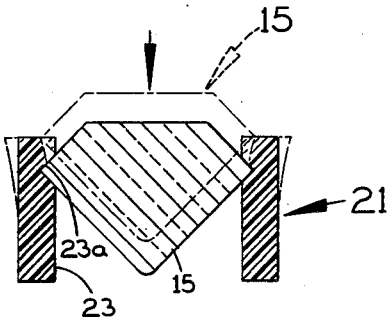
FIG. 5 is an enlarged sectional view taken on line 5—5 in FIG. 4, the gem and the opposite sidewall portions of the seat being shown in broken lines as the gem is being snapped into seated position.

The injection wax used to mold wax model 20 is formulated to provide the resiliency to sidewalls 23 required for snapping gems 15 into seats 22. A wax formulation of equal parts of the two waxes known in the trade as green and yellow wax has been found to achieve satisfactory results. This formulation of green and yellow wax is heated and injected into cavity 28 of rubber mold 25 through a suitable sprue (not shown). In accordance with conventional lost wax procedure, wax model 20 is removed from mold 25 immediately after the wax hardens. When upper mold section 26 is separated from lower mold section 27, wax model 20 remains on circular portion 27*a* and is readily removed therefrom by compressing the relatively soft rubber of circular portion 27*a* to disengage ledges 27*c* and lateral projections 27*b* from grooves 23*a* and seats 22, respectively. Upon removal of wax model 20 from circular portion 27*a* of open lower mold section 27, gems 15 are snapped into their set position in seats 22 wherein portions of each girdle 15*a* engage opposite undercut grooves 23*a*. This may be readily accomplished by using a suitable tool to align each gem 15 above its set position and applying downward pressure on table 15*c* of crown 15*b* thereby outwardly flexing the upper edge portion of sidewall 23 as seen in broken lines in FIG. 5. As girdle 15*a* enters undercut grooves 23*a*, sidewall 23 snaps back into normal position wherein the pair of opposing grooves 23*a* grippingly retain gem 15 set in seat 22. To insure gripping engagement of girdle 15*a* by undercut grooves 23*a*, the snapping back of sidewall 23 may be aided by applying gentle finger pressure urging the opposite upper edge portions of sidewall 23 toward each other. The setting of all the gems 15 in seats 22 of wax model 20 completes the first phase of the method.

The second phase of the method embodying the invention, which involves the preparation of the investment mold and the casting of the precious metal article with the gems preset therein, proceeds with the step of mounting the wax model 20 set with gems 15 on a wax tree which may also mount other wax models to be cast in precious metal in the same operation. As is conventional in the lost wax procedure, the tree is supported on a sprue base and surrounded by a cylindrical flask positioned on the base to form a container into which the investment slurry is carefully poured. After the investment hardens, the sprue base is removed and the flask heated in a vacuum oven from room temperature to approximately 600° C., the temperature rise being carefully controlled at a uniform rate of about 1.3° C. per minute for a period of approximately 7 hours during which time the wax is eliminated from the mold cavity and the investment material cured for receiving injection of the molten precious metal.

Figure 6:
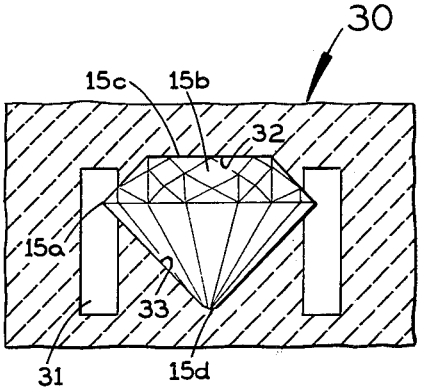
FIG. 6 is an enlarged fragmentary sectional view of the investment mold cavity showing the gem retained in position after the wax is removed and preparatory to the casting of the precious metal therein.

Investment mold 30 is shown in FIG. 6 to comprise the cured investment material after the 7 hour heating and curing period hereinbefore described has elapsed and in which mold cavity 31 is formed to conform in detail to wax model 20. The wax of model 20 having been eliminated from cavity 31, each gem 15 is now retained in position between a mold portion 32 abutting crown 15*b* and table 15*c* and a mold portion 33 opposite portion 32 abutting the culet or tip 15*d* and the conical walls of gem 15 so that portions of girdle 15*a* extend into cavity 31 for subsequent retaining engagement by undercut grooves formed when the precious metal is cast therein.

Casting in mold 30 is then performed by injecting molten precious metal into cavity 31 through the sprue passageways provided in mold 30 by the wax tree and sprue base in the manner well known in the art. The temperature of the molten precious metal when injected is held as close to the melting point of the particular metal alloy as is practical for casting purposes while for optimum results the temperature of mold 30 preparatory to the injection is brought to between 547° C. and 550° C. After casting is completed, mold 30 is permitted to slowly cool before the metal casting is removed by breaking the mold. This slow cooling may be acccomplished by setting aside mold 30 with the casting therein at room temperature for a period of about 24 hours or over night. After the precious metal casting is removed from the broken mold 30, the various articles are severed from the sprue and the precious metal ring cast from wax model 20, which has gems 15 preset in their respective seats, is polished to a desired finish.

Examples of gems 15 which may be preset by this method include, but are not limited to, diamonds, sapphires, rubies and various synthetic gems made to simulate diamonds, such as cubic zirconia.

The uniform heating of the investment mold 30 to a maximum of 600° C. during a time period of about 7 hours has been found to avoid cracking or other destructive marring of gems 15 embedded in mold 30 and to accomplish the required curing of the investment material to a hardened surface for mold cavity 31 capable of withstanding the temperature and pressure of the molten metal during casting and rendering a true reproduction of design details. However, the curing of the surface of mold cavity 31 may be insufficient to provide a smooth surface to the precious metal casting which when removed from mold 30 has a porous surface layer which is readily removed by conventional polishing techniques.

Figure 7:
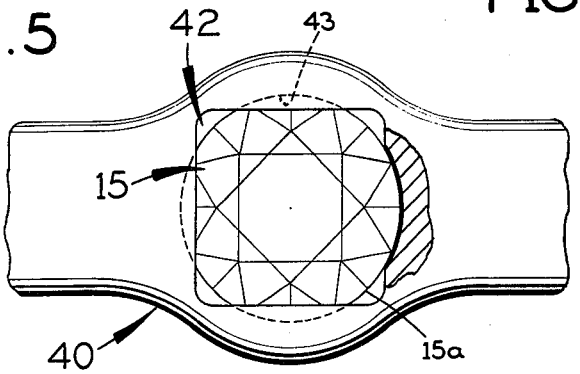
FIG. 7 is an enlarged fragmentary top plane view of a finished ring having a modified setting embodying the invention wherein four undercut grooves retain the gem.

FIG. 7 illustrates a completed finger ring 40 manufactured in precious metal in accordance with the invention and having a single seat 42 in which gem 15 is set. Seat 42, being a modified form of seat 12, is substantially rectangular in shape and formed with opposite sidewalls having two pairs of opposing undercut grooves 43 in which portions of girdle 15*a* of gem 15 engage.

It will now be apparent that the hereinbefore described method is applicable to the manufacture of a wide variety of gem decorated articles of jewelry, as for example, brooches, pins, pendants, bracelets, earrings, tie pins, cuff links and lockets, in which each gem has a girdle and the sidewall of each setting seat comprises two or more undercut grooves which engage the girdle of the gem and coact with each other to retain the gem in the seat. Thus, the gems may be cut in a variety of shapes well recognized in the art, as for example, square, baguette, bullet, keystone, marquise, old mine or pear shapes, and the setting seat formed in the metal is shaped to accommodate and conform to the particular gem and has the undercut grooves appropriately located in the sidewall to permit the gem to be readily snapped into the seat in the wax model and to achieve a secure setting in the finished metal casting.

The method of manufacturing jewelry by casting precious metal with gems preset therein to eliminate the costly services of the gem setter is seen to achieve the several objects of the invention and to be well adapted to meet conditions of practical use. As various possible embodiments might be made of this invention, and as various changes might be made in the disclosed method, it is to be understood that all matters herein set forth or shown in the accompanying drawing are to be interpreted as illustrative and not in a limiting sense.

What is claimed is:

1. In the manufacture of an article of jewelry cast in precious metal by a lost wax procedure and having a seat in which a gem is preset, the gem having a girdle and the seat having a sidewall formed with opposing undercut grooves in which portions of the girdle engage as gem retention means, the method comprising the steps of molding a wax model having a seat with a sidewall formed with opposing undercut grooves, the wax model being formed from a wax having a predetermined resiliency enabling flexing of the sidewall of said seat, snapping a gem having said girdle into set position in said seat by application of downward pressure on the gem to resiliently flex said sidewall permitting portions of the girdle to enter into engagement with said opposing undercut grooves, mounting the wax model with the gem set in the seat on a wax tree, embedding the wax tree in investment material in a flask, raising the temperature of the flask by predetermined increments and time intervals to a predetermined temperature to remove the wax and cure the investment material providing a mold cavity with the gem suspended therein, injecting molten precious metal into the mold cavity to form a metal casting in which the girdle of said suspended gem is engaged by undercut grooves of the metal casting, cooling the flask and its contents, and breaking the investment material after the flask and its contents cool to remove the precious metal article with the gem preset in said seat.

2. The method defined in claim 1 including a final step of polishing said precious metal article after removal from the broken investment material.

3. The method defined in claim 1 including the steps of fashioning a metal master article of jewelry having a seat with a sidewall formed with opposing undercut grooves, and making a rubber mold from said master article in which said wax model is molded.

4. The method defined in claim 1 in which the wax of said wax model is a formulation of equal parts of green and yellow wax.

5. The method defined in claim 1 in which said step of molding the wax model is performed in a rubber mold, the wax model being removed from the mold upon hardening, and said snapping of the gem into said seat is performed immediately after the wax model is removed from the rubber mold.

6. The method defined in claim 1 in which said predetermined temperature to which said flask is raised is 600° C.

7. The method defined in claim 1 in which the raising of the temperature of the flask by predetermined increments and time intervals is a uniform rate of 1.3° C. per minute for about a 7 hour period to a predetermined temperature of 600° C.

8. The method defined in claim 1 in which the cooling of the flask and its contents is performed slowing by setting the flask aside at room temperature at least over night.

9. The method defined in claim 7 including the step of bringing the flask to a temperature of between 547° C. and 550° C. prior to said injection of the molten precious metal.

* * * * *